US007445257B2

(12) United States Patent
Müller et al.

(10) Patent No.: US 7,445,257 B2
(45) Date of Patent: Nov. 4, 2008

(54) CLOSING SYSTEM FOR A DOOR, LID OR THE LIKE, PARTICULARLY THOSE OF VEHICLES

(75) Inventors: Benjamin Müller, Wuppertal (DE); Andreas van den Boom, Essen (DE); Helmut Schumacher, Coesfeld-Lette (DE)

(73) Assignee: Huf Hülsbeck & Fürst GmbH & Co, KG, Velbert (DE)

( * ) Notice: Subject to any disclaimer, the term of this patent is extended or adjusted under 35 U.S.C. 154(b) by 696 days.

(21) Appl. No.: 10/520,727

(22) PCT Filed: Jul. 1, 2003

(86) PCT No.: PCT/EP03/06974

§ 371 (c)(1),
(2), (4) Date: Jan. 7, 2005

(87) PCT Pub. No.: WO2004/007876

PCT Pub. Date: Jan. 22, 2004

(65) Prior Publication Data

US 2006/0071755 A1 Apr. 6, 2006

(30) Foreign Application Priority Data

Jul. 17, 2002 (DE) ..... 102 32 244

(51) Int. Cl.
*E05B 3/00* (2006.01)

(52) U.S. Cl. ..... 292/336.3; 292/DIG. 30; 292/DIG. 25; 340/693.5; 340/693.6

(58) Field of Classification Search ..... 292/336.3, 292/DIG. 30, DIG. 25; 16/110.1; 340/5.72, 340/5.2, 5.62, 693.5, 693.6; 70/208, 210, 70/278.1; 701/45, 49
See application file for complete search history.

(56) References Cited

U.S. PATENT DOCUMENTS 5,134,392 A * 7/1992 Takeuchi et al. ..... 340/5.62

(Continued)

FOREIGN PATENT DOCUMENTS

DE 196 17 038 A1 11/1997

(Continued)

*Primary Examiner*—Patricia Engle
*Assistant Examiner*—Mark Williams
(74) *Attorney, Agent, or Firm*—Friedrich Kueffner

(57) ABSTRACT

The invention relates to a closing system comprising handles (20) for operating latches that are inoperative when in a locked position, and only enable the latch to open when the latch is in an unlocked position. In conjunction with an access authorization device, the approaching of a hand to the handle (20) can be sensed in advance by a capacitive sensor thus enabling a very early reversing of the latch into the respectively desired position. To this end, two electrodes (51, 52) are integrated inside the handle (20), and a shielding (53) is located between these electrodes. One electrode (51) generates an inner field (50) between the handle (20) and the vehicle (10) and, with the vehicle body, acts as a capacitive inner sensor. The other electrode (52),however, generates an outer field (60) with regard to the surrounding area of the vehicle. When, during normal use of the handle (20), the hand passes into the area of the inner field (50), a first function in the latch or vehicle is carried out. In contrast, when the hand is brought towards the handle (20) from the outside, the dielectric properties in the outer field (60) are altered thereby leading to a second function in the latch or vehicle.

24 Claims, 4 Drawing Sheets

U.S. PATENT DOCUMENTS 6,191,682 B1 * 2/2001 Wolfgang ..... 340/5.2
6,577,228 B1 * 6/2003 Tsuchida et al. ..... 340/5.72
6,740,834 B2 * 5/2004 Sueyoshi et al. ..... 200/600
6,768,413 B1 * 7/2004 Kemmann et al. ..... 340/5.72
7,132,768 B2 * 11/2006 Ieda et al. ..... 307/652
7,199,317 B2 * 4/2007 Ieda et al. ..... 200/61.62
2004/0257296 A1 * 12/2004 Ieda et al. ..... 343/872

FOREIGN PATENT DOCUMENTS

DE 100 51 055 A1 5/2002

* cited by examiner

FIG. 4
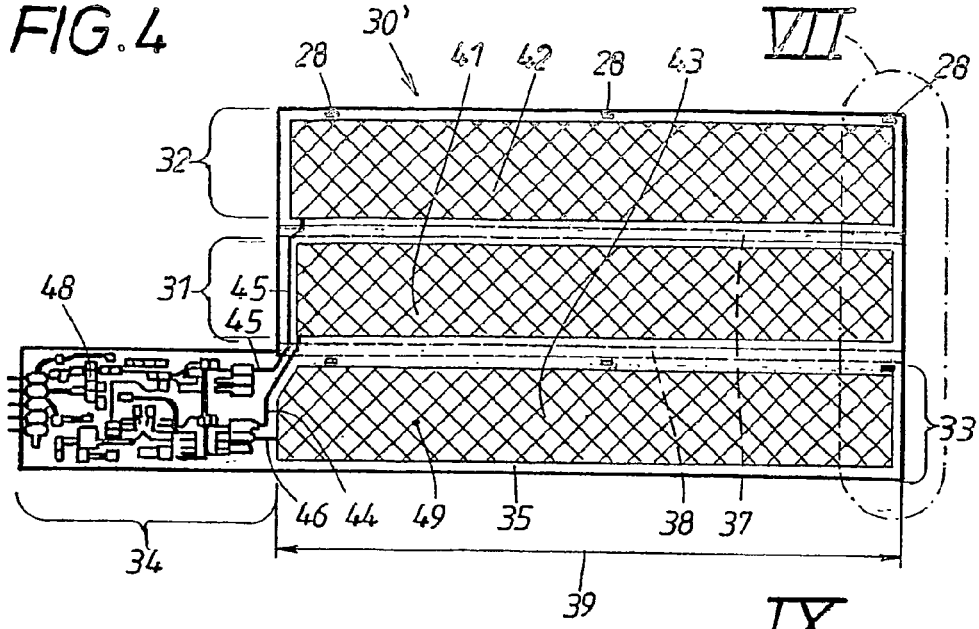
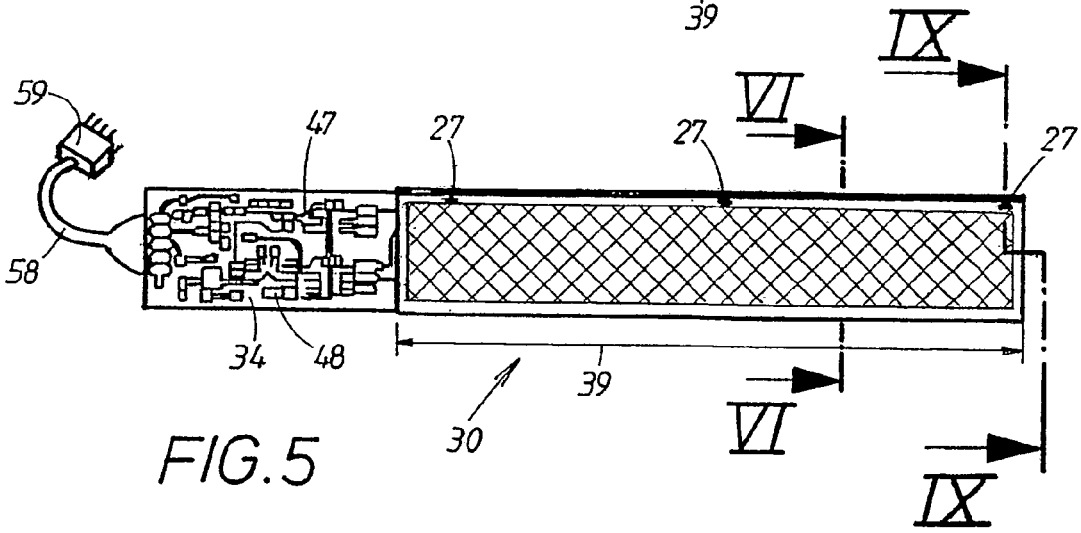
FIG. 5
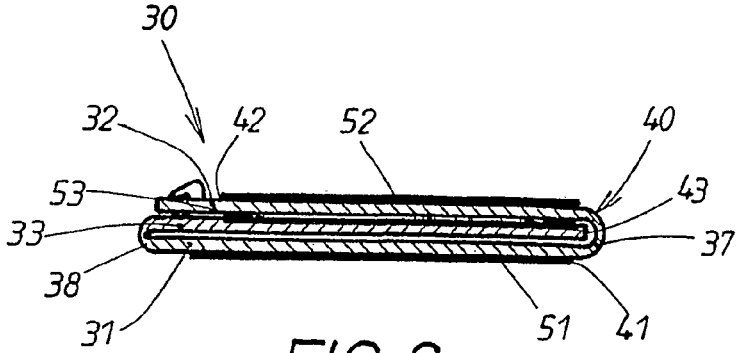
FIG. 6

CLOSING SYSTEM FOR A DOOR, LID OR THE LIKE, PARTICULARLY THOSE OF VEHICLES

BACKGROUND OF THE INVENTION

1. Field of the Invention

The invention pertains to a lock system which comprises an access authorization device, which consists of a stationary part in the vehicle and a mobile part carried by the authorized person. A specific function in the lock or in the vehicle is triggered upon the initiation and successful completion of a data exchange between the mobile part and the stationary part.

2. Description of the Related Art

It is known that a capacitative sensor in the handle can be used to initiate this data exchange (DE 196 17 038 C2). This sensor creates a uniform field in the area of the handle and responds when a human hand approaches the field. Then the previously mentioned data exchange begins; and, upon completion of this exchange, the function by which the lock is switched to its release position is triggered. This lock system offers the advantage that the lock is switched to its release position even before the handle is actuated. This means that the door can be opened quickly. A push button, which must be actuated to switch the lock back into its locking position, is mounted on the outside of the handle. An additional manual operation is thus required, which is burdensome. The vehicle owner must learn how to perform this additional operation. The switching of the lock in the one direction via the capacitative sensor and in the other direction via the pus button requires the use of two different systems, which must be coordinated with each other. In addition, each of the two systems requires its own system-specific components. This occupies space in the area of the handle, space which is already in short supply.

It is already known (DE 100 51 055 A1) that two electrodes for two capacitative sensors can be installed in the handle with shielding between them. The two electrodes generate two spatially separate electric fields. The one electrode generates an inner field in the intermediate space between the handle and the vehicle. When a human hand arrives in the area of this inner field, the lock is switched to its release position. The other electrode generates an outer field between the handle and the area surrounding the vehicle. When the authorized person, i.e., the person who is carrying the mobile part belonging to the vehicle, arrives within a defined minimum distance from the handle, the lock is switched to its locking position. In one case, the two electrodes are mounted on the same side of a common circuit board, offset from each other in the vertical direction. This means that a large amount of space is required to install the electrodes in the handle. In another case, the two electrodes are realized on a multilayer circuit board. The production of such multilayer circuit boards, however, is expensive and time-consuming.

SUMMARY OF THE INVENTION

The invention is based on the task of developing a reliable lock system of the type cited above which is compact and which can be produced easily and inexpensively According to the invention, three circuit board parts with conductive traces are provided which are connected to each other by film hinges. The inner electrode is mounted on the first circuit board part, the outer electrode is mounted on the second circuit board part, and the shielding is mounted on the third circuit board part. The three circuit board parts can be converted from a large, flat, spread-out condition, allowing the production of the two electrodes and the shielding, to a compact, collapsed condition by folding them together into a three-layer folded product. The finished folded product forms a unit which is integrated as a single structural unit into the handle.

The hinges make it possible to produce the individual circuit board parts easily, because they are in the flat, spread-out position during the production process. In this phase, the circuit board parts extend over a large area, as a result of which the two electrodes and the shielding can be produced without interference from each other. These components can therefore be manufactured inexpensively and conveniently. For use in the handle, however, the circuit board parts are folded over onto each other and thus made into a compact, collapsed unit. A folded-up, three-layer product with a small base surface is obtained. The space-saving, compact folded product thus obtained can be easily installed in the limited space available in the interior of the handle. The design also allows fast and easy installation.

It is especially advantageous for the circuit board parts of the folded product to be designed as a one-piece unit in the form of three adjacent sections of a single overall board. These three sections are separated from each other by film hinges. Then at least one conductive trace can cross the area of the film hinge and thus connect two or all three of the adjacent sections of the folded product electrically together.

BRIEF DESCRIPTION OF THE DRAWING

In the drawing:

FIG. 4 shows the structural unit, which is still outside the handle in FIG. 2, in a previous stage of fabrication, namely, a plan view of a preliminary product, where three circuit board parts connected to each other in a hinge-like manner are in their flat, spread-out state;

FIG. 5 shows a fabrication stage following that of FIG. 4, namely, a plan view of the finished product, which is obtained by folding the preliminary product of FIG. 4 into a compact unit in which the circuit board parts are folded onto each other;

FIG. 6 shows, on a magnified scale, a cross section through the structural unit along the cross-sectional line VI-VI of FIG. 5;

DETAILED DESCRIPTION OF THE INVENTION

Figure 1:
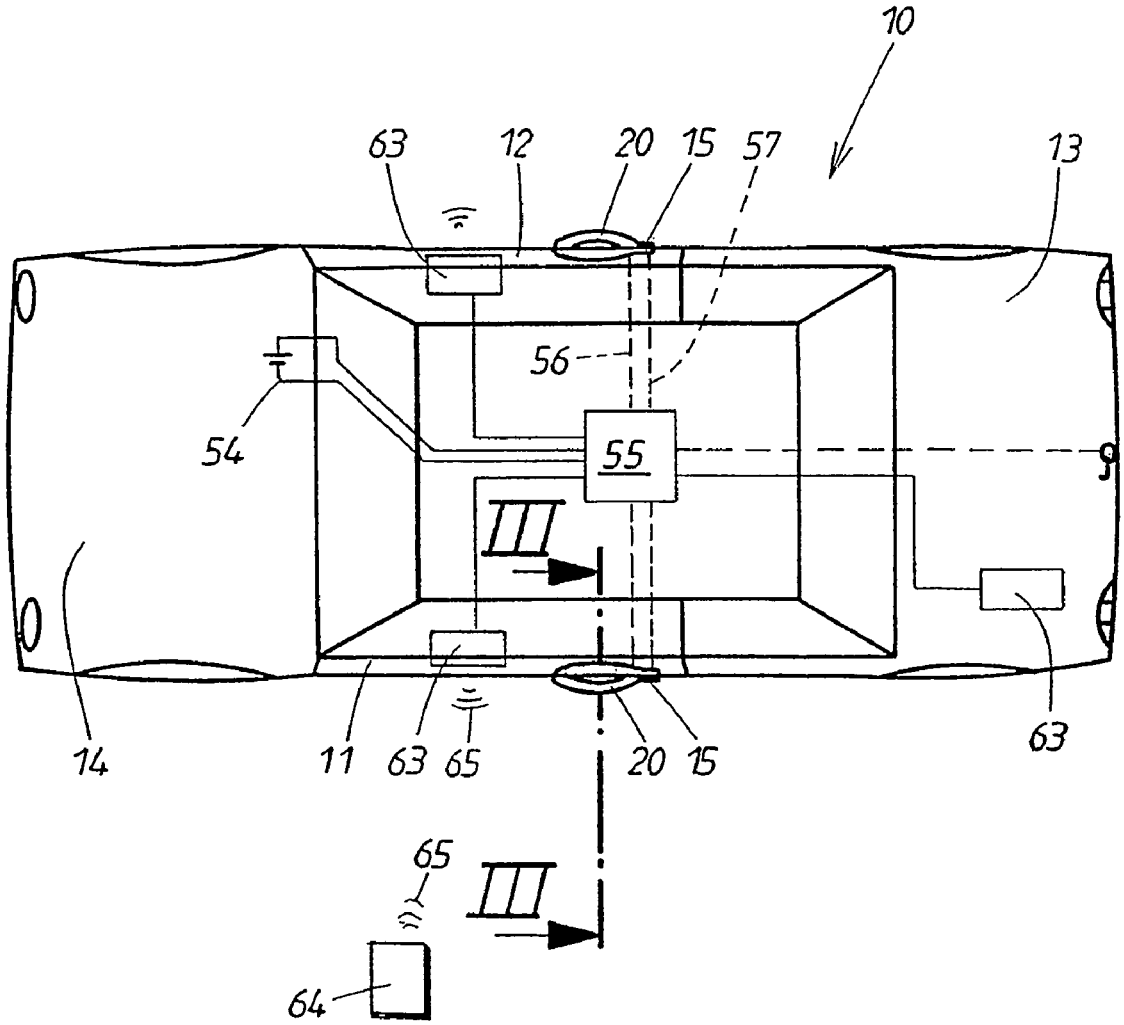
FIG. 1 shows a schematic plan view of a vehicle, into which an inventive lock system has been integrated.

The lock system according to the invention not only saves a great deal of space but also makes it possible for the authorized user to gain access to the vehicle 10 in an especially quick and convenient manner while also reliably preventing unauthorized third parties from doing the same. In the exemplary embodiment shown, access to the vehicle is possible through two doors 11, 12, through a hatch 13, and through a hood 14. All these movable parts 11-14 are held in their locked positions on the body by the same or different locks 15. The locks can be switched jointly between their locking positions and their release positions by means of a known central control unit. It is sufficient to explain this in greater detail on the basis of one of the handles 20, belonging to one of the doors 11.

Figure 2:
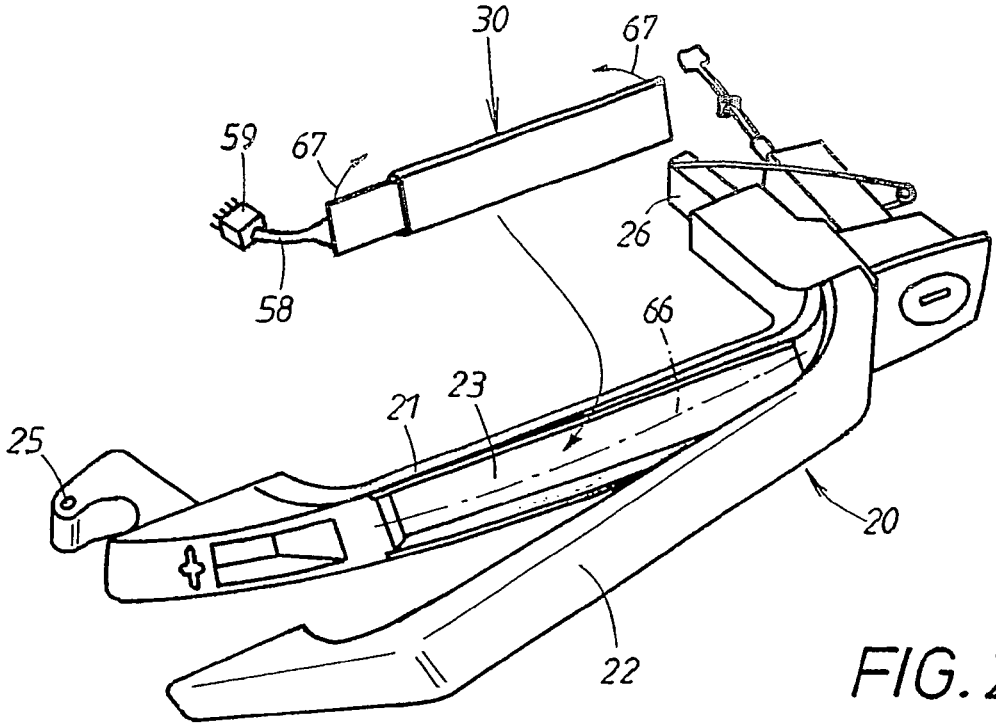
FIG. 2 is an exploded, perspective view of a handle belonging to a door of the vehicle of FIG. 1 before a preassembled structural unit, also shown in perspective, is installed in it.

As FIG. 2 shows, the handle can have a two-part design, consisting, for example, of a base shell 21 and a cover shell 22, between which a space 23 is present to hold a separate electrical component 30. In the present case, the handle 20 is designed as a so-called "pull" handle, which has a pivot bearing 25 at one end and a shaft 26 at the other end, the shaft acting via intermediate elements on the associated lock 15 in the door 11. The handle 20 is advisably located near a grip well 16 in the outer panel of the door 11, so that an intermediate space 17 is created there between the handle 20 and the outer door panel of the vehicle 10.

Figure 7:
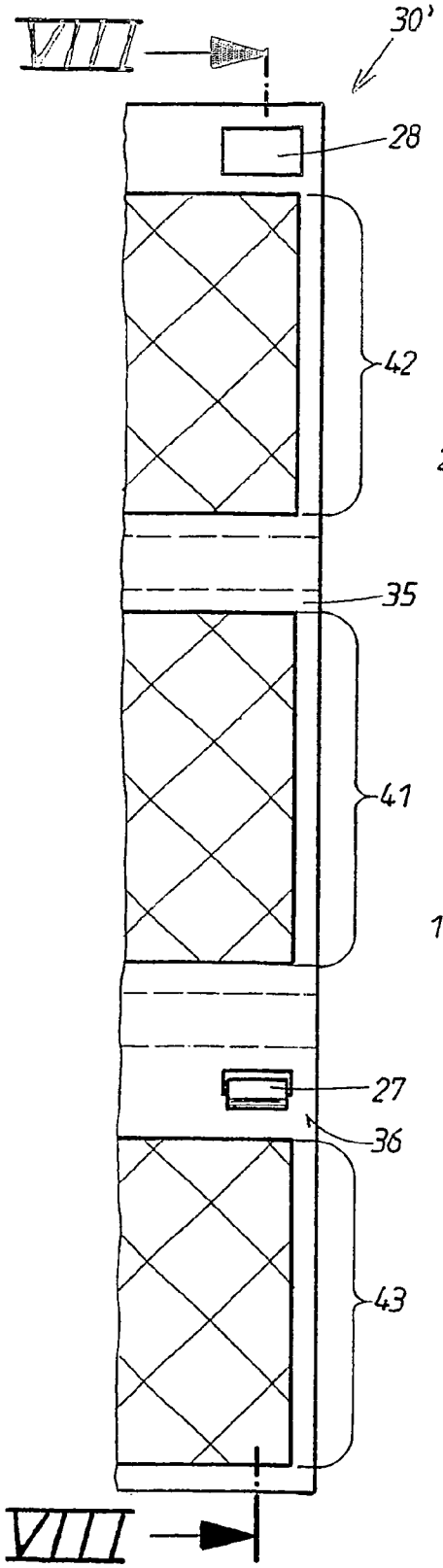
FIG. 7 shows, on a magnified scale, a plan view of the edge area of the unfolded structural unit indicated at VII in FIG. 4.
Figure 8:
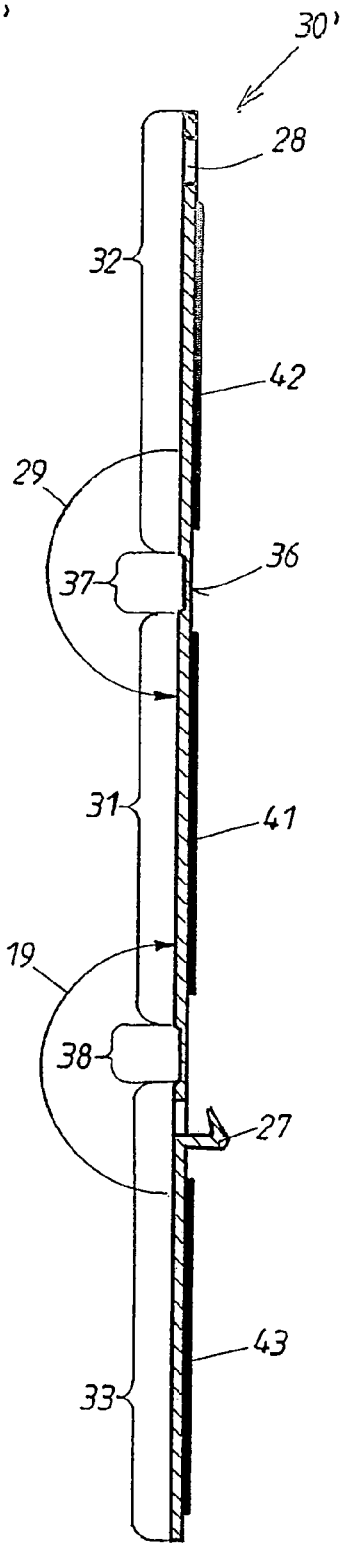
FIG. 8 shows a longitudinal cross section through the preliminary product of FIG. 7 along the cross-sectional line VIII-VIII in that figure.
Figure 9:
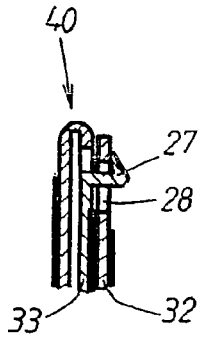
FIG. 9, also on a magnified scale, shows a partial cross section through the finished structural unit of FIG. 5 along the cross-sectional line IX-IX in that figure.

FIG. 4 shows, the preliminary fabrication stage 30' of the structural unit 30, in which the unit is in the flat initial state, whereas FIG. 5 shows the finished state. This unit comprises a flexible leaf 35, functioning as the overall circuit board, on the flat side 36 of which, as can be see in FIGS. 7 and 8, three conductive areas 41, 42, 43 and three conductive traces 44, 45, 46 are located. Two linear film hinges 37, 38, which are parallel to each other, extend down the length of the leaf 35; these hinges divide the overall circuit board into three strip-like sections 31, 32, 33. The hinges 37, 38 make it possible for the individual sections 31, 32, 33 to be folded over twice 19, 29 to form a three-layer folded product 40, as shown in FIG. 6.

The finished folded product 40 can be held together by snap connectors 27, 28. In the present case, the two cooperating halves of these connectors consist of a flexible hook 27, which forms a single unit with the overall circuit board, and a hole 28 in the leaf 35. After the folding operations 19, 29, the hook 27 passes through the hole 28 and automatically grips the outer edge area of the hole 28. Several of these snap connectors 27, 28 are distributed along the longitudinal edges of the sections 32, 33.

As can be seen from the flat preliminary product 30', there is also a fourth section 34. This section is designed as an extension of the third section 33 and is therefore outside the actual folded zone characterized by the number 39. This fourth section 34 is formed from the same leaf material 35 and also has conductive traces 47. The difference, however, is that various electrical components 48, which are part of a complex control system for the inventive lock, are mounted on this extension and are connected to the conductive traces 47. The previously mentioned conductive traces 44, 45, 46, which lead to the various conductive areas 41, 42, 43, therefore proceed from the electrical components 48 mounted on the extended section 34. It is worth mentioning that the conductive traces 44, 45 leading to the neighboring sections 31, 32 continue without interruption across the area of the film hinges 37, 38 and therefore ensure contact between the conductive surfaces 42, 41 present there and the corresponding components 48 on the extension 34. As can be seen at 49, the three conductive areas 41, 42, 43 are each formed by intersecting conductive traces, which form a grid 49 on each of the sections 31, 32, 33. The conductive traces can cover the entire surface and can have any desired geometry.

Each of the conductive areas 41-43 has a different function to fulfill. After the finished unit 30 has been installed in the handle 20 and connected to the required components in the vehicle 10, these areas form the electrodes 51, 52 of two capacitative sensors 61, 62, each with its own manner of operation, as will be explained in greater detail on the basis of FIGS. 3 and 6. The electrical cable 58 projecting from the unit 30 in FIGS. 2 and 5 and the contact parts 59 are used for this purpose. The one electrode 51 produces a first electrical field 50 according to FIG. 3 extending toward the body of the vehicle 10; this field is created in the previously mentioned intermediate space 17 between the handle 20 and the well 16. This field 50, as previously mentioned, will therefore be called in brief the "inner field", and this electrode 51 will be called the "inner electrode". This inner electrode 51 is shielded from the other electrode 52 by a third conductive surface 43, which is grounded, and which, in the folded state 40 of FIG. 6, is located between the other two electrodes. The third surface therefore functions as the shielding 53.

Figure 3:
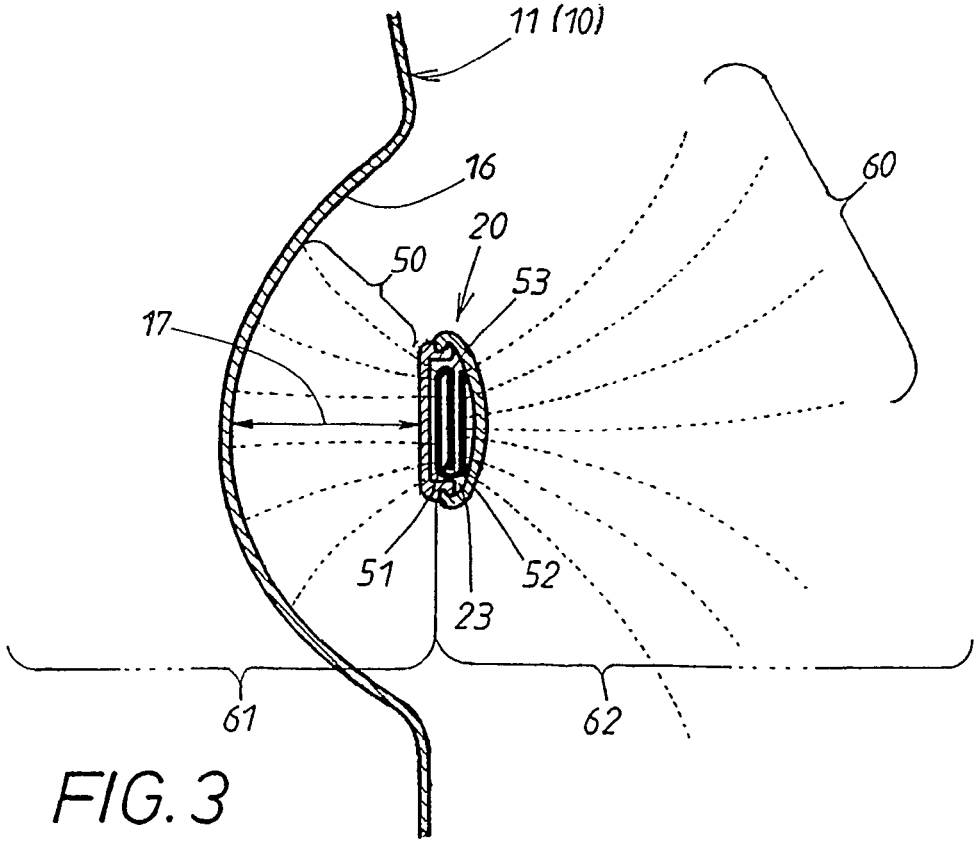
FIG. 3 is, on a magnified scale, a cross section through part of the door shown in FIG. 1, along the cross-sectional line III-III indicated in that figure, where only the components lying in the cross-sectional plane are illustrated.

When voltage is applied, the other electrode 52 generates a second electrical field 60, according to FIG. 3, directed toward the outer environment of the vehicle. Because this field 60, from the perspective of the handle 20, is directed outward, it will be called the "outer field", as previously mentioned. It is independent of the inner field 50. The electrode 62 used to generate this outer field 60 will therefore be called correspondingly the "outer electrode". The way in which the inner and outer fields 50, 60 work can be explained best on the basis of the schematic diagram of FIG. 1.

There is in the vehicle 10 at least one control unit 55, which is fed by a power source such as the vehicle's battery 54. The control unit 55 is connected via control lines 56 and supply lines 57 to the previously mentioned electrical cable 58 of the unit 30. The inventive lock system also comprises an electronic access authorization system, which includes a stationary part, installed permanently in the vehicle. Some of the components of the stationary part are integrated into the control unit 55. The rest of the stationary part consists of one or more transmitting and receiving units 63, which are installed at various suitable points in the vehicle.

The mobile part 64, in the form of a "check card" as indicated schematically in FIG. 1, is carried by the authorized person. Transmitting and receiving units, a memory circuit, power sources, and control components (not shown) are integrated into this card in a manner known in and of itself. When the authorized person comes within a certain suitable distance of the vehicle 10, the stationary part 55 can initiate a mono- or multi-directional data exchange 65 by electromagnetic means with the mobile part 64 of the access authorization device. The inner field 50 and the outer field 60 are generated at the handle 20 by this time at the latest. When the authorized person now puts his/her hand behind the handle 20 of FIG. 3, the inner electrical field 50 present there is altered. This is detected by the associated first sensor 61, which then switches the lock 15 and, in the case of a central control unit, additional locks or all of the locks of the vehicle 10 to their release position. The lock 15 has already been unlocked by the time the authorized person has gripped the handle 20. Since the door 11 or 12 has now been released, pulling the handle 20 outward has the effect of opening the door. Because the function of this first, lock-releasing sensor 61 is to switch the lock 16 the position in which the door can be opened, it will be called the "opening sensor," in the following.

When the authorized person leaves the vehicle 10, he or she can, if in possession of the mobile part 64, cause the locks 15 to lock themselves automatically. To close the opened door, the hand will approach the handle 20 from the outside and thus arrive in the area of the outer field 60. The inward-moving hand causes a change in the capacitance, which is detected by the second capacitative sensor 62. In this case, the control unit will switch the lock 15 or all of the locks into their locking position. After the authorized person carrying the mobile part 64 has left the vehicle 10 and shut the doors 11, 12, he/she can thus lock them so that they cannot be opened by unauthorized persons. The second sensor 62, which is operating in this case, can therefore be called in an analogous manner the "locking sensor".

It would also be possible for the control system to generate the inner field 50 and the outer field 60 only in an alternating manner. When, for example, the lock 15 is in its locking position, there is no need for the outer field 60. It is sufficient for the system to generate only the inner field 50 and for only the opening sensor 61 to be active. When, in contrast, the lock 15 is in its release position, there is no need for the inner field 50. It is then sufficient for the system to generate only the outer field 60 and for only the locking sensor 62 to be in operation.

If the technique of generating the two fields 50, 60 in alternation as described above is used, there is also no longer any need for the intermediate shielding 53. In this case, it would then be sufficient for the folded product 30 to have only two layers; that is, the third section 33 could be omitted. The previously described extension section 34 would then be positioned on one of the two remaining sections 31, 32. The inner field 50 could then extend over certain areas of the outer field 60 and vice versa.

If the handle 20 does not consist of two components 21, 22, which are made separately and then attached to each other, but rather of a single unit with one or more components made by means of the injection molding process, for example, then the unit 30 can be introduced as an insert into the empty injection mold and surrounded on all sides by the molding compound. Only the electrical cable 58 and the contact parts 59 would project to the outside.

Finally, it would also be possible to integrate the transmitting and receiving units 63 belonging to the stationary part of the access authorization device into the handle as well. They could then also be a component of the previously described unit 30.

The flexible leaf 35 for making the previously described folded product 40 and the unit 30 also obviously makes the finished unit 30 flexible. If the handle 20 has the curvature 66 in the mounting area 23 indicated in FIG. 2 in dash-dot line by way of example, then, when the unit 30 is laid in place, it can be bent in the direction of the arrows 67 of FIG. 2 without impairment to its function. Because the folded unit 30 is very thin and is made of flexible plastic, it can be conveniently bent 67. As a result of this flexibility, the unit 30 can be adapted to handles of any profile 66 and can extend over much of the length of the handle 20. This promotes the generation of large and effective inner and outer fields 50, 60 and allows optimal utilization of the space available in the handle 20.

LIST OF REFERENCE NUMBERS

10 vehicle
11 first door of 10
12 second door of 10
13 hatch of 10
14 hood of 10
15 lock at 11 or 12
16 well at 20
17 intermediate space
19 first fold, folding movement
20 handle
21 base shell of 20
22 cover shell of 20
23 mounting space in 20
25 pivot bearing of 20
26 shaft, working element on 20
27 first half of a snap connection, hook
28 second half of a snap connection, hole
29 second fold, folding movement
30 electrical unit
30' flat preliminary product of 30
31 first section of 35
32 second section of 35
33 third section of 35
34 extension of 33, fourth section of 35
35 overall circuit board, flexible leaf
36 a flat side of 35
37 first film hinge between 31 and 32
38 second film hinge between 31 and 33
39 fold zone of 30, 30' (FIGS. 4, 5)
40 folded product (FIGS. 5, 6)
41 first conductive area, on 31
42 second conductive area, on 32
43 third conductive area, on 33
44 second conductive trace, on 33, 32, 31
45 first conductive trace on 33, 31
46 third conductive trace, on 33
47 conductive trace on 34
48 electrical component on 34
49 intersection conductive traces, grid on 41-43
50 first electrical field, inner field (FIG. 3)
51 first electrode, inner electrode, produced by 41
52 second electrode, outer electrode, produced by 42
53 shielding, produced by 43
54 power source, vehicle battery
55 control unit, stationary part of the access authorization device (FIG. 1)
56 electrical control line of 55
57 electrical supply line of 55
58 electrical cable projecting from 30 (FIGS. 2, 5)
59 electrical contact part on 58 (FIGS. 2, 5)
60 second electrical field, outer field (FIG. 3)
61 first capacitative sensor, opening sensor
62 second capacitative sensor, locking sensor
63 transmitting and receiving unit of the stationary part of the access authorization system
64 mobile part of the access authorization system, check card
65 data exchange between 63 and 64 (FIG. 1)
66 curvature of 20 (FIG. 2)
67 bending movement of 30 (FIG. 2)

The invention claimed is:

1. Lock system for for motor vehicles (10), the lock system comprising, a lock (15) on the door (11) to be actuated by a handle (20);

two electrodes (51, 52) comprising an inner and an outer electrode with two capacitative sensors (61, 62) and shielding (53) in the handle (20), the shielding being located between the two electrodes, wherein the electrodes generate two spatially separate electrical fields at least for certain periods of time, the electrical fields comprising:

an inner field (30), generated in an intermediate space (17) between the handle (20) and the vehicle (10) by the inner electrode (51), and an outer field (60), generated between the handle (50) and the outside environment of the vehicle (10) by the outer electrode (52);

an electronic access authorization device, having a stationary part (63) installed in the vehicle (10) and electrically connected to the two electrodes (51, 52) of the two sensors (61, 62), and a the mobile part (60) adapted for being carried by an authorized person;

wherein the one sensor (61) with the inner electrode (51) responds when a human hand arrives in an area of the inner field (50) and initiates a first function in the lock (15) or in the vehicle after a data exchange between the mobile part (64) and the stationary part (63) has been successfully completed; and wherein the other sensor (62) with the outer electrode (52) becomes active when the hand arrives in an outer field (60) within a certain defined minimum distance from the handle (20) and then initiates a second function in the lock (15) or in the vehicle, further comprising:

three circuit board parts provided with conductive traces (44, 45, 46) and connected to each other by film hinges (37, 38); wherein the inner electrode (51) is mounted on the first circuit board part, the outer electrode (52) is mounted on the second circuit board part, and the shielding (53) is mounted on the third circuit board part; wherein the three circuit board parts are movable between a large, flat, spread-out condition, allowing the production of the two electrodes (51, 52) and the shielding (53), and a compact, collapsed condition by folding them together into a three-layer folded product (40); and wherein the finished folded product (40) forms a unit (30), which is integrated as a single structural unit into the handle (20).

2. Lock system according to claim 1, wherein, for carrying out the first function, the lock (15) is switched to its release position and for carrying out the second function, the lock is switched to its locking position;

whereby the one sensor (61) functions as the opening sensor and the other sensor (62) functions as the locking sensor.

3. Lock system according to claim 1, wherein, in a finished, folded product (40), the three circuit board parts rest on each other over essentially their entire surface areas.

4. Lock system according to claim 1, wherein the three circuit board parts are composed of a single piece consisting of the three adjacent sections (31, 32, 33) of the overall circuit board (35); and wherein the overall circuit board (35) is divided into three sections (31, 32, 33) by foldable film hinges (37, 38).

5. Lock system according to claim 4, wherein at least one conductive trace (44, 45) passes across at least one of the film hinges (38, 37) and connects two or all three sections (31, 32, 33) of the folded product (40) to each other electrically.

6. Lock system according to claim 4, wherein the overall circuit board (35) has two linear film hinges (37, 38)

which are parallel to each other and divide the overall circuit board (35) into three strip-like sections (31, 32, 33).

7. Lock system according to claim 1, wherein the overall circuit board (35) or the circuit board parts consist of a flexible leaf; and in that, when the folded product (40) is being installed, the flexible leaf is able to bend (67) to conform to a curvature (66) of the handle (20).

8. Lock system according to claim 1, wherein the conductive traces (44, 45, 46) and/or the conductive areas (41, 42, 43) of the inner electrode (51), of the outer electrode (52), and of the shielding (53) are located on the same flat side (36) of the overall circuit board (35) or leaf.

9. Lock system according to claim 1, wherein the conductive areas (41, 42, 43) of the inner electrode (51), of the outer electrode (52), and/or of the shielding (53) cover the entire surface.

10. Lock system according to claim 1, wherein the conductive areas (41, 42, 43) of the inner electrode (51), of the outer electrode (52), and/or of the shielding (53) are produced in the form of a grid of conductive traces.

11. Lock system according to claim 1, wherein the conductive areas (41, 42, 43) of the inner electrode (51), of the outer electrode (52), and/or of the shielding (53) are of conductive traces of a geometric pattern.

12. Lock system according to claim 1, wherein the conductive traces (44, 45, 46) and the conductive areas (41, 42, 43) of the electrodes (51, 52) and of the shielding (53) are produced on the overall circuit board (35) or the leaf by a MID technique (Molded Interconnect Device).

13. Lock system according to claim 1, wherein the conductive traces (44, 45, 46) and the conductive areas (41, 42, 43) of the electrodes (51, 52) and of the shielding (53) on the overall circuit board (35) or on the leaf are produced by hot foil stamping.

14. Lock system according to claim 1, wherein the conductive traces (44, 45, 46) and the conductive areas (41, 42, 43) of the electrodes (51, 52) and of the shielding (53) on the overall circuit board or on the leaf are produced by a two-component injection-molding technique.

15. Lock system according to claim 1, wherein the individual layers of the finished folded product (40) are held together by snap connections (27, 28).

16. Lock system according to claim 15, wherein the snap connections consist of two connecting halves (27, 28), which are integral parts of the circuit boards or sections (32, 33) of the overall circuit board (35).

17. Lock system according to claim 16, wherein one half of the connection consists of a projecting hook (27), whereas the other consists of a hole (28) in the circuit board part or in a section (32) of the overall circuit board (35); and in that the hook (27) is flexible and, in the finished product, is not only aligned with the hole (28) but also engaged with the hole (28) to produce an effective retaining action.

18. Lock system according to claim 1, where in the overall circuit board (35) or leaf has a electrical components mounted on the fourth section (34), which serves as a carrier for the electrical components (48); and in that the electrically conductive traces (44, 45, 46) of at least one of the other sections (31, 32, 33) of the folded product (40) are electrically connected to these components.

19. Lock system according to claim 18, wherein, although the fourth section (34) is designed as an extension of one of the three sections (33) belonging to the folded product (40), it lies outside the folded area (39).

20. Lock system according to claim 18, wherein the electrical components (48) mounted on the fourth section (34) evaluate the data (65) exchanged between the mobile part (64) and the stationary part (63) of the access authorization device.

21. Lock system according to claim 18, wherein the components (48) mounted on the fourth section (34) comprise at least some elements which serve to switch the lock (15) and/or actuators in the vehicle between a first and a second function.

22. Lock system according to claim 18, wherein the electrical components (48) provided on the fourth section (34) include at least some of the transmitting and/or receiving elements (63), which are used for the data exchange (65) between the mobile part (64) and the stationary part of the access authorization device.

23. Lock system according to claim 1, wherein the fourth section (34) provided with the electrical components (48) is a component of the preassembled unit (30), which is inserted into a cavity (23) in the handle.

24. Lock system according to claim 1, wherein the fourth section (34) provided with the electrical components (48) is a component of the preassembled unit (30), which is laid as an insert into the injection mold for the injection-molding of the handle (20) and is enclosed on all sides by the injection-molding compound during the molding process, where the unit (30) is provided with projecting electrical cables (58) or electrical contacts (59), which project out from the injection-molding compound.

* * * * *